US008368608B2

(12) United States Patent
Parsche

(10) Patent No.: US 8,368,608 B2
(45) Date of Patent: Feb. 5, 2013

(54) CIRCULARLY POLARIZED LOOP REFLECTOR ANTENNA AND ASSOCIATED METHODS

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 593 days.

(21) Appl. No.: 12/110,617

(22) Filed: Apr. 28, 2008

(65) Prior Publication Data

US 2009/0267850 A1 Oct. 29, 2009

(51) Int. Cl.
*H01Q 13/00* (2006.01)

(52) U.S. Cl. ..... 343/775; 343/772; 343/700 MS; 343/909

(58) Field of Classification Search ..... 343/840, 343/912, 909, 772, 775, 778, 834, 835, 842, 343/700 MS
See application file for complete search history.

(56) References Cited

U.S. PATENT DOCUMENTS

| | | | | |
|---|---|---|---|---|
| 1,892,221 | A | 12/1932 | Runge | 343/853 |
| 3,122,745 | A | 2/1964 | Ehrenspeck | 343/819 |
| 3,231,892 | A * | 1/1966 | Matson et al. | 343/775 |
| 3,924,239 | A | 12/1975 | Fletcher et al. | 343/909 |
| 4,017,865 | A | 4/1977 | Woodward | 343/781 |
| 4,467,330 | A | 8/1984 | Vidal et al. | 343/872 |
| 4,516,133 | A | 5/1985 | Matsumoto et al. | 343/819 |
| 4,905,014 | A | 2/1990 | Gonzalez et al. | 343/909 |
| 6,054,963 | A | 4/2000 | Muterspaugh | 343/741 |
| 6,081,234 | A * | 6/2000 | Huang et al. | 343/700 MS |
| 6,081,235 | A * | 6/2000 | Romanofsky et al. | 343/700 MS |
| 6,198,457 | B1 * | 3/2001 | Walker et al. | 343/840 |
| 6,522,302 | B1 | 2/2003 | Iwasaki | 343/726 |
| 7,031,652 | B2 | 4/2006 | Blodgett et al. | 455/3.01 |
| 7,719,463 | B2 * | 5/2010 | Migliaccio et al. | 342/188 |
| 2008/0024368 | A1 * | 1/2008 | Chang et al. | 343/700 MS |

FOREIGN PATENT DOCUMENTS

| | | |
|---|---|---|
| EP | 1881556 | 1/2008 |
| GB | 2328319 | 2/1999 |
| JP | 05191136 | 7/1993 |

(Continued)

OTHER PUBLICATIONS

Chulmin Han and Kai Chang, Ka-Band Reflectarray Using Ring Elements, Electronics Letters, Mar. 20, 2003, vol. 39, No. 6, pp. 491-493.*

Chao-Chun Chen, Transmission of Microwave Through Perforated Flat Plates of Finite Thichness, IEEE Transactions on Microwave Theory and techniques, vol. MTT-21, No. 1, Jan. 1973, pp. 1-6.*

"The Short Backfire Antenna", Proceedings of the IEEE, 53, 1138-1140, Aug. 1965.

"The Turnstile Antenna", George Brown, Electronics, 9, 15, Apr. 1936, 5 pages.

*Primary Examiner* — Dieu H Duong

(74) *Attorney, Agent, or Firm* — Allen, Dyer, Doppelt, Milbrath & Gilchrist, P.A.

(57) ABSTRACT

The antenna may include a planar reflector having a plurality of loop electrical conductors defining an array of parasitically drivable antenna elements, and a circularly polarized antenna feed spaced from the planar reflector to parasitically drive the array of parasitically drivable antenna elements and impart a traveling wave current distribution therein. The antenna may have properties that are hybrid between parabolic reflectors and driven arrays, providing a relatively compact circularly polarized antenna capable of having low wind load. Closed circuit or loop elements may provide increased gain over antennas using dipole turnstile reflector elements.

20 Claims, 7 Drawing Sheets

FOREIGN PATENT DOCUMENTS

| | | | |
|---|---|---|---|
| JP | 2005504474 | | 2/2005 |
| JP | 2005184012 | | 7/2005 |
| JP | 2008035461 | | 2/2008 |
| WO | 03028154 | | 4/2003 |
| WO | WO 2006097736 | A1 * | 9/2006 |
| WO | 2007052112 | | 5/2007 |
| WO | WO 2007052112 | A1 * | 5/2007 |
| WO | WO 2008004838 | | 1/2008 |

* cited by examiner

CIRCULARLY POLARIZED LOOP REFLECTOR ANTENNA AND ASSOCIATED METHODS

FIELD OF THE INVENTION

The present invention relates to the field of communications, and, more particularly, to antennas and related methods.

BACKGROUND OF THE INVENTION

In the field of radio frequency (RF) communications, it is often desirable to be able to focus, direct, or otherwise manipulate an RF signal. Traditionally this has been accomplished by placing a reflective surface in the signal path, either to gather and focus a signal being received or to concentrate a transmitted signal. While flat surfaces reflect RF energy, their effect is very much like an optical mirror in that they reflect an incident signal at an orthogonal angle to the angle of incidence and, consequently, perform no concentrating or focusing function. The use of a curved (e.g., a parabolic) surface, however, does provide a concentrating, focusing function.

The use of satellite communications has increased the demand for circularly polarized antennas and for dual polarization antennas. For instance, many of the satellite transponders in use today carry two programs on the same frequency by using separate polarizations. Thus, a single antenna structure may be called upon to simultaneously receive two polarizations, or perhaps to transmit in one polarization and receive in another. The single antenna structure therefore separates the two polarization channels, to a high degree of isolation.

It is possible to have dual linear or dual circular polarization channel diversity. That is, a frequency may be reused if one channel is vertically polarized and the other horizontally polarized. Or, a frequency can also be reused if one channel uses right hand circular polarization (RHCP) and the other left hand circular polarization (LHCP). Polarization refers to the orientation of the E field in the radiated wave, and if the E field vector rotates in time, the wave is then said to be rotationally or circularly polarized.

An electromagnetic wave (and radio wave, specifically) has an electric field that varies as a sine wave within a plane coincident with the line of propagation, and the same is true for the magnetic field. The electric and magnetic planes are perpendicular and their intersection is in the line of propagation of the wave. If the electric-field plane does not rotate (about the line of propagation) then the polarization is linear. If, as a function of time, the electric field plane (and therefore the magnetic field plane) rotates, then the polarization is rotational. Rotational polarization is in general elliptical, and if the electric field vector extremity describes a circle over time then the polarization is circular. The polarization of a transmitted radio wave is determined in general by the transmitting antenna (and feed)—by the type of the antenna and its orientation. For example, the monopole antenna and the dipole antenna are two common examples of antennas with linear polarization. An axial mode helix antenna is a common example of an antenna with circular polarization, and another example is a crossed array of dipoles fed in quadrature. Linear polarization is usually further characterized as either Vertical or Horizontal. Circular Polarization is usually further classified as either Right Hand or Left Hand.

The dipole antenna has been perhaps the most widely used of all the antenna types. It is of course possible however to radiate from a conductor which is not constructed in a straight line. Preferred antenna shapes are often Euclidian, being simple geometric shapes known through the ages. In general, antennas may be classified as charge separation or charge conveyance types, corresponding to dipoles and loops, and line and circle structures.

Radiation can occur from 3 complimentary forms of the same geometry: panel antennas, slot antennas and skeleton antennas. In dipoles, these can correspond to a flat metal strip, a straight slot cut out of a flat metal sheet, or a rectangle of wire. Thus, the same antenna geometry may be reused in accordance with Babinet's Principle.

Circular polarization for dipole antennas has been attributed to George Brown, which was described in the literature as "*The Turnstile Antenna", Electronics,* 9, 15, Apr. 1936. In the dipole turnstile, crossed orthogonal dipoles are fed in phase quadrature: 0, 90 degrees at the dipole ports. The phases at the dipole terminals are 0, 90, 180, and 270 degrees from each other at all times.

Approaches to circular polarization in loop antennas appear lesser known, or perhaps even unknown in the purest forms. For instance, the present edition "Antenna Engineering Handbook", R. Johnson and H. Jasik editors, does not describe methods to obtain circular polarization from a single loop antenna. In spite of the higher gain of the full wave loop vs. the half wave dipole (3.6 dBi vs. 2.1 dBi), dipoles are commonly used for circular polarization needs, as for instance in turnstile arrays. Both the dipole turnstile and a single loop antenna are planar, in that their thin structure lies nearly in a single plane.

While many structures are described as loop antennas, the canonical loop shape is that of a circle. The resonant loop is a full wave circumference circular conductor, often called a "full wave loop". The typical prior art full wave loop is linearly polarized, having a radiation pattern that is a two petal rose, with two opposed lobes normal to the loop plane, and a gain of about 3.6 dBi. Plane reflectors are often used with the full wave loop antenna to obtain a unidirectional pattern.

Polarization diversity has commonly been obtained from crossed dipole antennas. For instance, U.S. Pat. No. 1,892,221, to Runge, proposes a crossed dipole system with the dipoles fed at 0 and 90 degree phasing. Although circular polarization resulted, only polarization diversity was described.

U.S. Pat. No. 6,522,302 to Iwasaki and entitled "Circularly-Polarized Antennas" is directed to a circularly polarized antenna array rather than a single circularly polarized loop element. A circle is among the most elemental of antenna structures, and may be the most fundamental single geometry capable of circular polarization.

Communication satellites are in widespread use for communicating data, video and other forms of information between widely spaced locations on the earth's surface. Antennas are transducers between transmission lines and free space. A general rule in antenna design is that, to direct or "focus" the available energy to be transmitted into a narrow beam, a relatively large "aperture" is necessary. The aperture may be provided by a broadside array, a longitudinal array, or an actual physical aperture such as the mouth of a horn.

Another type of antenna is a reflector antenna, which in a receive mode, receives a collimated beam of energy and focuses the energy into a converging beam directed toward a feed antenna, or which, in a transmit mode, focuses the diverging energy from a feed antenna into a collimated beam. Those skilled in the art know that antennas are reciprocal devices, in which the transmitting and receiving characteristics are equivalent. Generally, antenna operation is referred to in terms of either transmission or reception, with the other mode being understood therefrom. A conventional reflector antenna 10, e.g. as shown in FIG. 1, may include a feed 12 and a dish 14, such as a parabolic dish, for focusing the energy.

U.S. patent application Ser. No. 11/609,046 entitled "Multiple Polarization Loop Antenna And Associated Methods" to Parsche et al. includes methods for circular polarization in loop antennas. A full wave circumference loop is fed in phase quadrature (0°, 90°) using two driving points.

U.S. Pat. No. 3,122,745 to Ehrenspeck is entitled "Reflection Antenna Employing Multiple Director Elements And Multiple Reflection Of Energy To Effect Increased Gain" is directed towards "backfire" antennas. A slow wave antenna, such as a yagi uda is pointed towards a plane reflector, for the enhancement of gain and the reduction of sidelobes. This was perhaps counterintuitive to common practice, as director elements of yagi-uda antennas are often towards the direction of communications. Backfire antennas are further described in "The Short Backfire Antenna", Proceedings Of the IEEE, 53, 1138-1140, August 1965.

U.S. Pat. No. 4,017,865 to Woodward is entitled "Frequency Selective Reflector System" and is directed to a dual-band Cassegrain antenna system. The antenna system includes a main parabolic reflector and a hyperbolic subreflector that reflects signals at a first band of frequencies and transmits signals at a second lower band of frequencies. The hyperbolic subreflector according to one embodiment is a square grid mesh with conductive rings centered along the connecting legs of the square grid mesh.

U.S. Pat. No. 6,198,457 to Walker, et al. is entitled "Low-wind Load Satellite Antenna" and is directed to a satellite communications antenna that includes a low-wind load reflector so that the antenna may be used on high wind load locations, such as on a ship. The reflector has a support structure which includes a grid-like structure having relatively large apertures therein to allow wind to pass therethrough. Unlike solid surfaced parabolic reflectors, the reflector in Walker et al. includes reflective radiating elements, such as dipoles, mounted to the support structure for focusing at least one desired frequency of operation.

The reflector in Walker et al. is designed to have low wind drag and is based upon the premise that any surface shape can be designed to electromagnetically act as though it were a parabolic reflector. A more detailed description of this concept is provided in U.S. Pat. No. 4,905,014 to Gonzalez et al., the disclosure of which is incorporated herein by reference and which is commonly referred to in the industry as FLAPS™ (Flat Parabolic Surface) technology, e.g. as illustrated in FIG. 2. The antenna 20 includes a feed 22 and reflector 24, and the effect is achieved by introducing appropriate phase delays at discrete locations along the reflector surface. In-phase combining occurs at the array "focus" due to the tuning of individual reflector elements. A typical implementation of the concept includes an array of shorted dipole scatterers 26 positioned above a ground plane or above a reflecting shorted dipole.

However, there is still a need for a low wind load satellite communications antenna with more gain at a reduced size, in the interests of convenience, utility and cost.

SUMMARY OF THE INVENTION

In view of the foregoing background, it is therefore an object of the present invention to provide a relatively compact circularly polarized antenna with sufficient gain and capable of having low wind load.

This and other objects, features, and advantages in accordance with the present invention are provided by an antenna including a planar reflector including a plurality of loop electrical conductors defining an array of parasitically drivable antenna elements, and a circularly polarized antenna feed spaced from the planar reflector to parasitically drive the array of parasitically drivable antenna elements by imparting a traveling wave current distribution thereon.

Each of the loop electrical conductors may comprise a circular electrical conductor, such as a wire, a printed conductive trace, a metal ring and/or a solid conductive disc. In other embodiments, the planar reflector may include an electrically conductive sheet including a plurality of circular holes therein, and each of the loop electrical conductors may then be defined by a periphery of one of the circular holes. The circular reflective elements may be embodied in the panel, slot, and skeleton compliments.

The planar reflector may include a dielectric mesh suspending the plurality of loop electrical conductors in the array. For example, the dielectric mesh may be a grid of strings or rods. The planar reflector may comprise a dielectric substrate having a plurality of openings therein and supporting the plurality of loop electrical conductors in the array. In addition, each of the plurality of loop electrical conductors may include at least one discontinuity therein.

A method aspect is directed to making an antenna including forming a planar reflector with a plurality of loop electrical conductors defining an array of parasitically drivable antenna elements, and positioning a circularly polarized antenna feed adjacent the planar reflector to parasitically drive the array of parasitically drivable antenna elements and impart a traveling wave current distribution therein. Forming the planar reflector may include forming a plurality of circular holes in an electrically conductive sheet, and each of the loop electrical conductors may be defined by a periphery of one of the circular holes.

Alternatively, forming the planar reflector may include forming a dielectric mesh suspending the plurality of loop electrical conductors in the array, including, for example, forming the dielectric mesh as a grid of strings or rods. Forming the planar reflector may include forming a plurality of openings in a dielectric substrate, and supporting the plurality of loop electrical conductors on the substrate.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
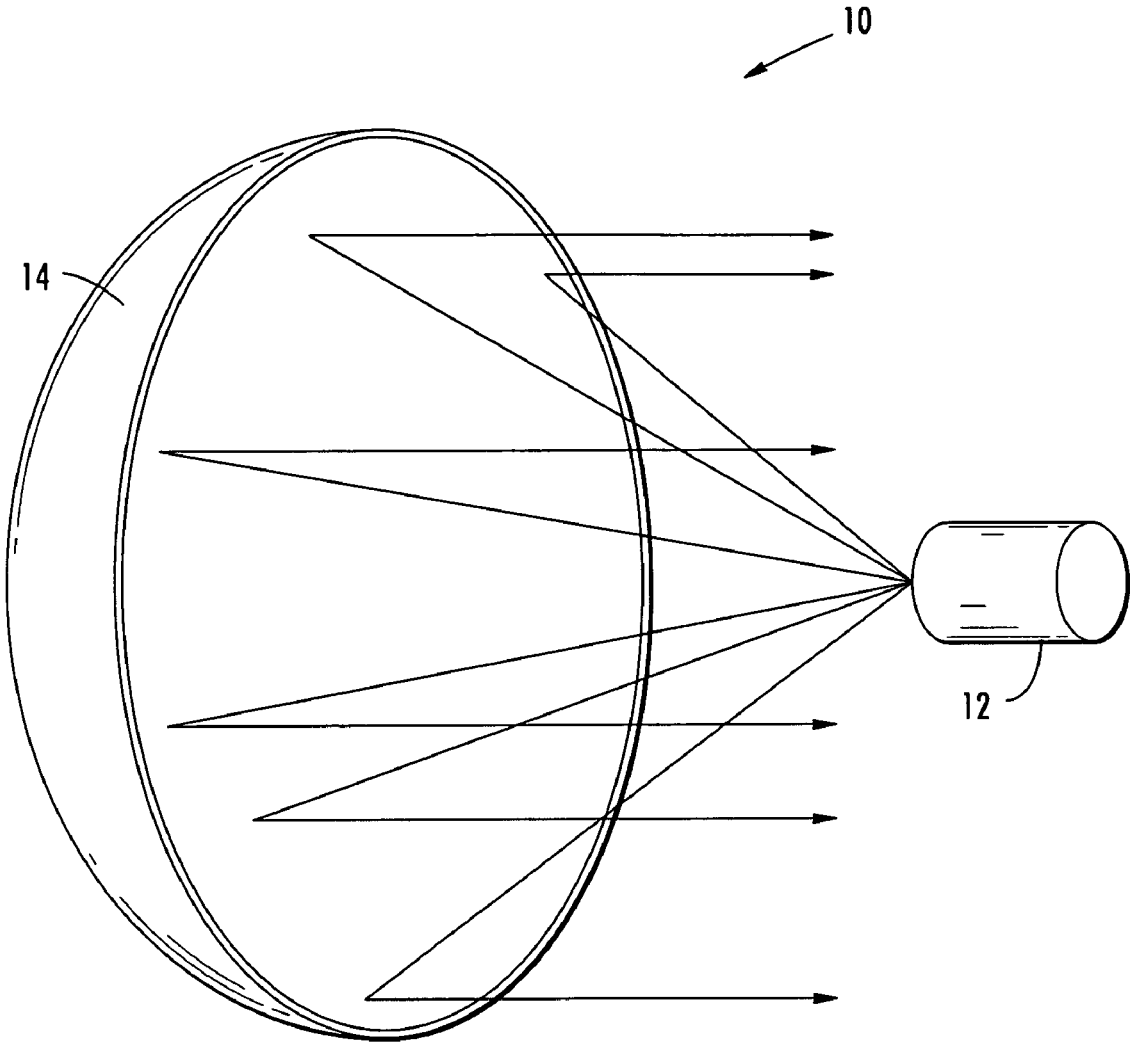
FIG. 1 PRIOR ART
FIG. 1 is a schematic perspective view of a parabolic reflector antenna according to the prior art.
Figure 2:
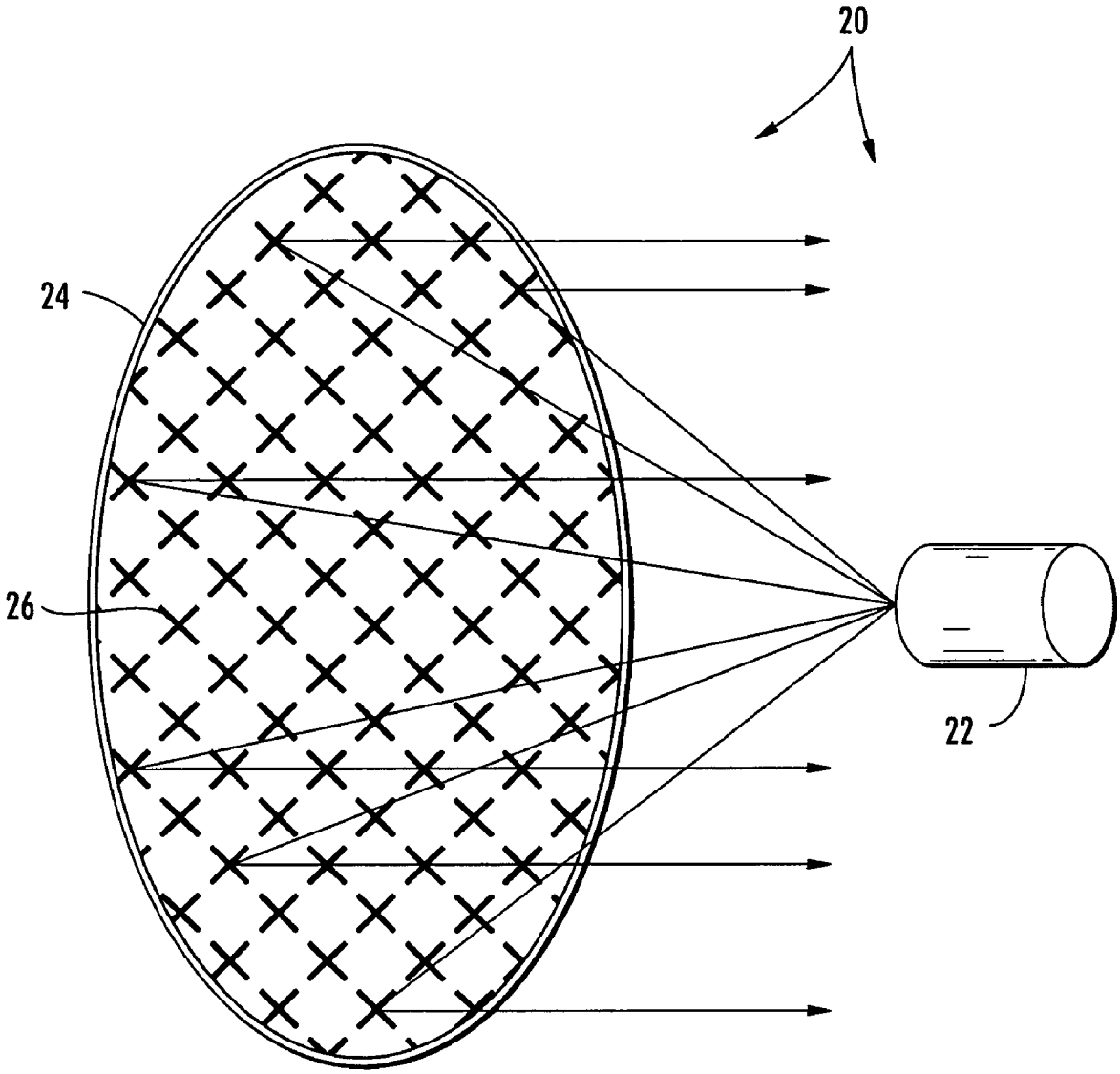
FIG. 2 PRIOR ART
FIG. 2 is a schematic perspective view of a FLAPS™ (Flat Parabolic Surface) antenna system according to the prior art.
Figure 3:
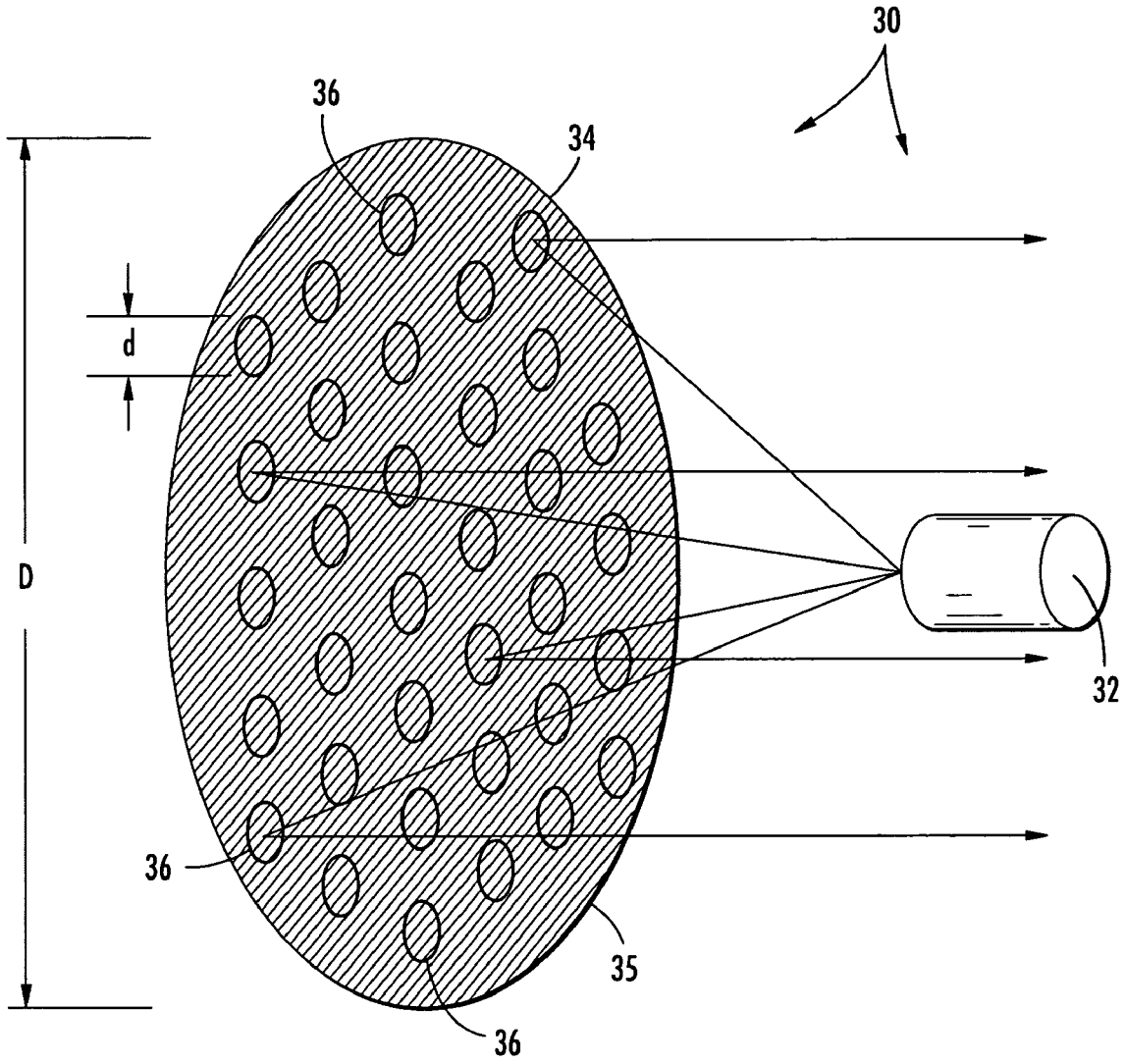
FIG. 3 is a schematic perspective view of an antenna in accordance with the present invention, showing a loop (skeleton compliment) embodiment.

Referring now to FIG. 3, a relatively compact circularly polarized antenna 30 with sufficient gain and the capability of having low wind load, will now be described. The antenna 30 includes a planar reflector 34 including a plurality of loop electrical conductors 36 defining an array 35 of parasitically drivable antenna elements. A circularly polarized antenna feed 32 is spaced from the planar reflector to parasitically drive the array 35 of parasitically drivable antenna elements and impart a traveling wave current distribution therein.

As illustrated, the antenna 30 includes loop electrical conductors 36, e.g. circular electrical conductors. Each of the loop electrical conductors 36 may be a conductive wire, tubing, a metal ring, printed conductive trace, etc. The circumference of loop electrical conductors 36 is preferably near full wave resonance, which is equal to about 1.04 wavelength (e.g. between 0.94 and 1.14 wavelengths depending on conductor diameter). Although the preferred shape of loop electrical conductors 36 is circular, the present invention is not so limited and other closed circuit shapes such as rectangles or polygons may be configured. Also, the loop electrical conductors 36 may be distorted from perfect circles into ellipses at further distances from the center of the reflector 34

Referring further to FIG. 3, a theory of operation for the present invention will now be described. Feed 32 radiates towards loop electrical conductors 36 exciting electrical currents thereupon. Loop electrical conductors 36 then reradiate the energy of feed 32, forming the individual radiating elements of a phased array 35, which may be a broadside phased array. Thus, feed 32 provides a primary pattern and the array 35 a secondary pattern, having higher directivity and gain by pattern multiplication and increased aperture. Although not so limited, loop electrical conductors 36 are typically operated in the nonreactive, radiating far field of feed 32.

Loop electrical conductors 36 may lie in a plane rather than on a parabola, in which case loop electrical conductors 32 outlying the center of array 35 would be excited with a time delay and lagging phase relative to loop electrical conductors 36 near the center. Since it is desirable to have the maximum radiation of antenna 30 broadside (normal) to the plane of array 35 it is preferred that all the loop electrical conductors 36 radiate in the same phase. Referring to FIG. 3, equal phasing may be accomplished in loop electrical conductors 36 by adjusting diameter d, which varies loop element phase of radiation by adjustment of resonance. Thus, varying loop diameters throughout array 35 serves to compensate for path length differences to the feed 32. Loop electrical conductors 36 may also in some cases include one or more discontinuities or gaps in the loop circumference for the control of phase.

Since loop electrical conductors 36 comprise array elements, their amplitude and phase of their currents determine the final radiation pattern shape. Illumination taper across the array may be optimized for greatest gain (uniform distribution), no sidelobes (binomial distribution) or a tradeoff in between by shaping of the primary pattern of feed 32. When array 35 is circular, uniform illumination and ideal taper efficiency may be accomplished when the feed pattern is $G_f(\theta')=\sec^2(\theta'/2)$ between the reflector bounds and $G_f(\theta')=0$ outside of the reflector bounds, as is common for solid parabolic reflectors (see "High Efficiency Microwave Reflector Antennas", P. Clarricoats and G. Poulton, Proc. Of the IEEE, Vol 65, No. 10, October 1977). The gain of wire element embodiments of the present invention may approach $G=3.6+10\ \mathrm{Log}_{10}(N)$, where N is the number of full wave loop elements and G is in dBi.

Feed 32 defines a "wireless beam forming network" to drive the elements of array 35. This eliminates transmission line losses inherent, for example, in a corporate feed network of coaxial cable. As no transmission line is used at the array elements, the elements of the array 35 do not require baluns or impedance matching. Array element spacing between loop electrical conductors 36 may be about 0.6 to 1.0 wavelengths center to center for maximum gain. Both in-line and offset feed approaches are possible for antenna 30. In an offset feed approach, the feed 32 can be displaced out of the main beam and to the side, as in parabolic reflectors that use only a portion of the parabola from which they are "cut". Offset feed approaches can reduce feed blockage for an increase in gain and a reduction in sidelobes.

Both dipole turnstiles and single loop antennas are capable of circular polarization. Circular loop antennas radiate circularly polarized electromagnetic waves when the current distribution around the loop circumference is of the traveling wave type. A traveling wave current distribution is uniform in amplitude and linear in phase, i.e. the current amplitude is constant at all points along the loop conductor and the phase changes linearly along the loop conductor. A traveling wave distribution is formed when the loop antenna is immersed in an incident wave that is circularly polarized, making a loop element suitable as a reflector in a circularly polarized antenna array. As background, full wave loop antennas radiate linearly polarized waves when their current distribution is sinusoidal.

Figure 4:
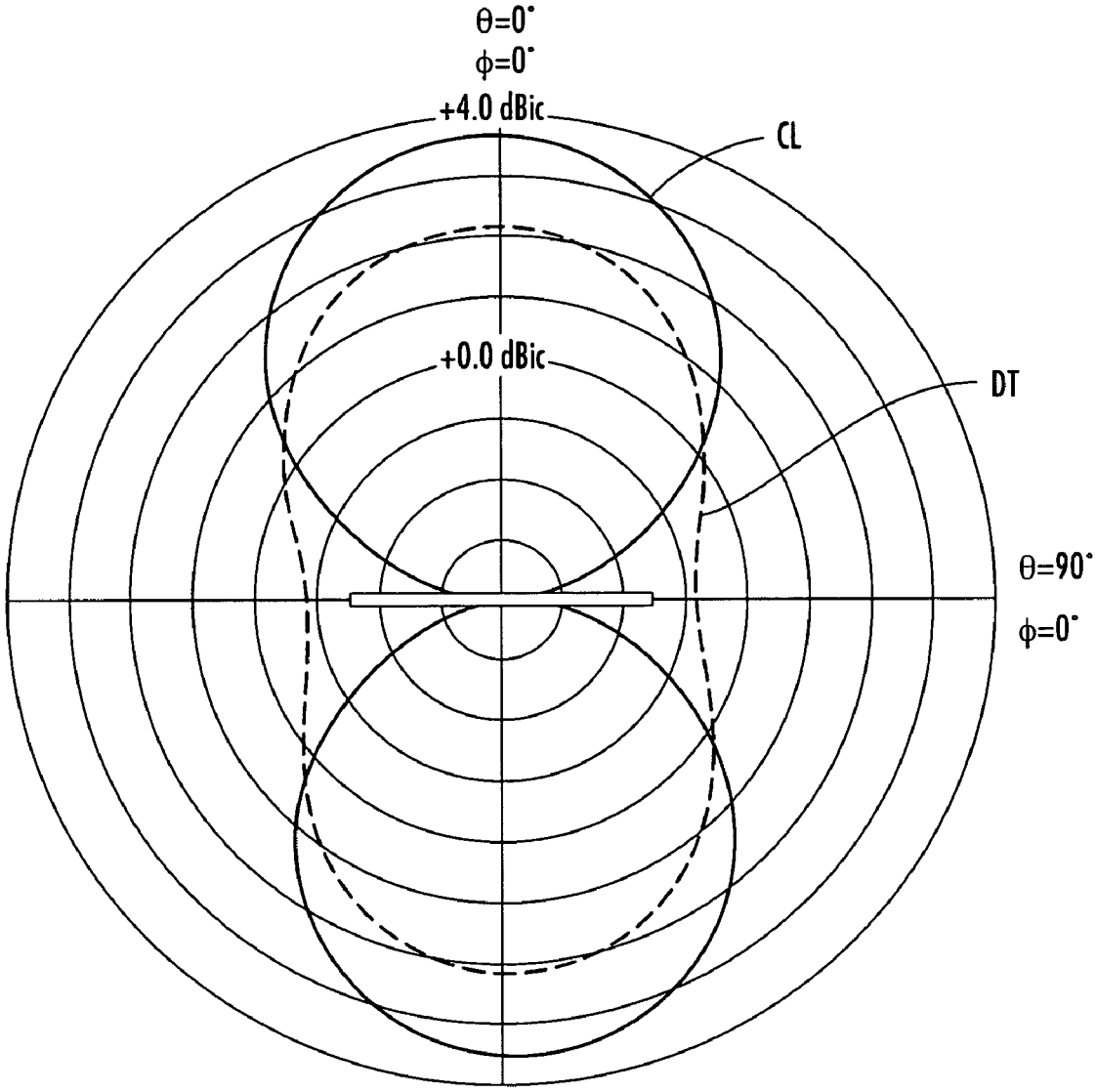
FIG. 4 is a chart illustrating the XZ plane elevation cut for the far field radiation pattern of the reflective antenna element of FIG. 3 compared to a conventional dipole turnstile element.

FIG. 4 is a chart illustrating the XZ plane (elevation cut) far field radiation pattern CL of an individual loop electrical conductor 36 of the antenna 30 of FIG. 3, compared to the far field radiation pattern DT cut across the plane of a conventional dipole turnstile element. As shown, the far field radiation pattern CL of the loop electrical conductor 36 of the antenna 30 of FIG. 3 results in a gain of 3.6 dBic compared to the gain of 2.1 dBic of the dipole turnstile element. Thus, an increase in the gain of about 1.4 dB may be achieved with the antenna 30. A full wave circumference circular loop element takes up slightly less area than a turnstile of crossed half wave dipoles.

Figure 5:
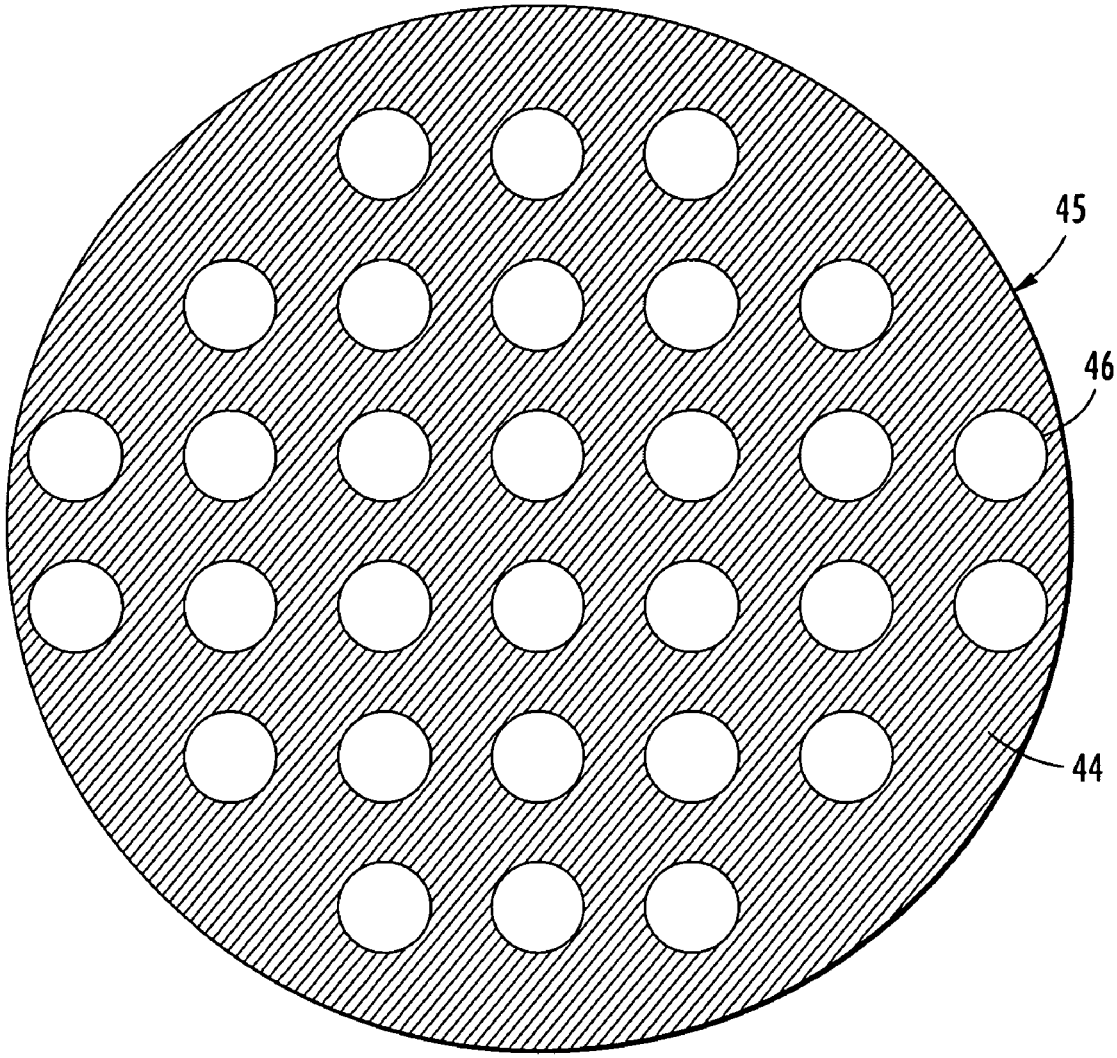
FIG. 5 is a schematic top plan view of a disc (panel compliment) embodiment of the reflector and the array of loop electrical conductors in accordance with the present invention.
Figure 6:
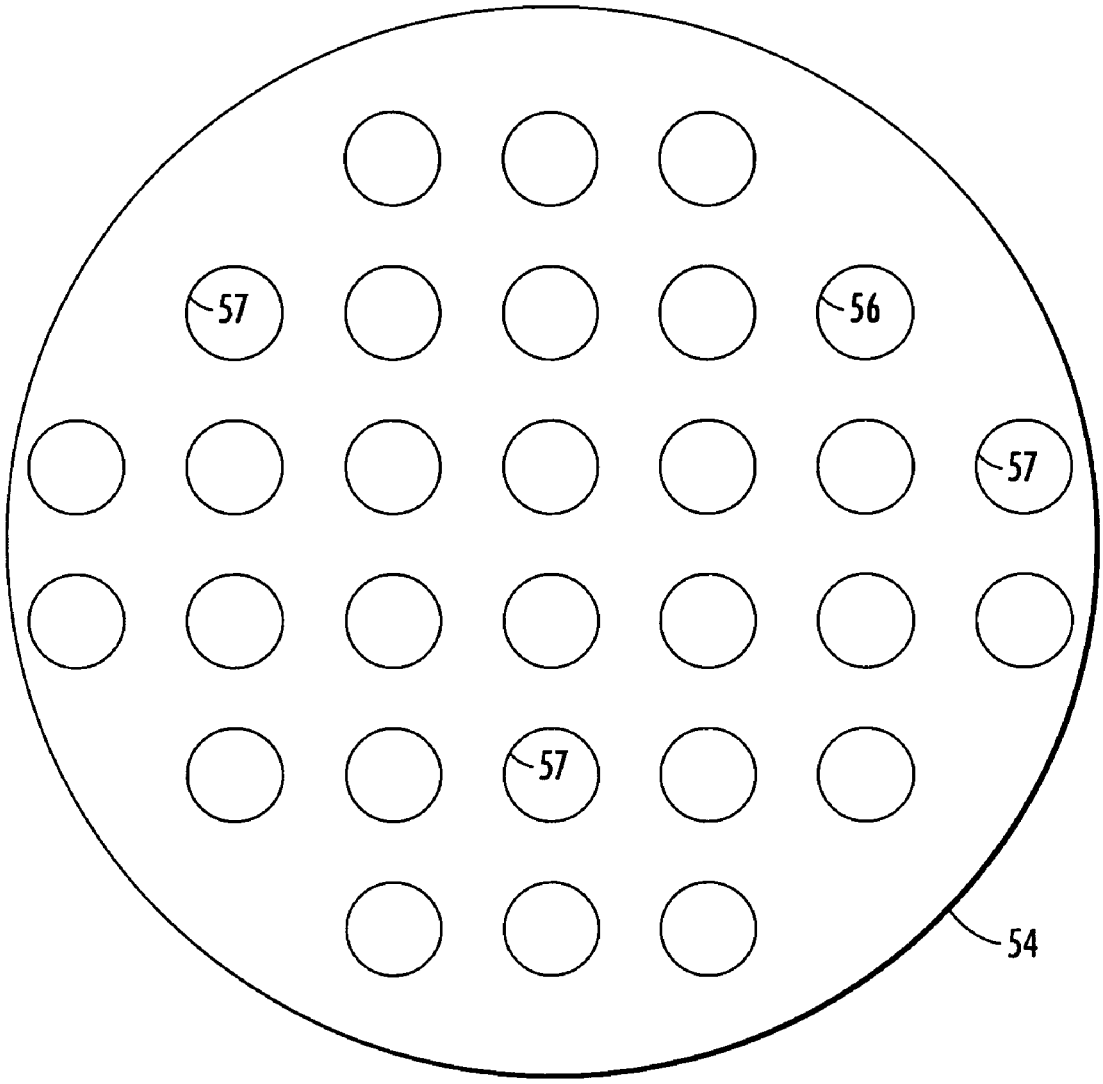
FIG. 6 is a schematic top plan view of a hole (slot compliment) embodiment of the reflector and the array of loop electrical conductors in accordance with the present invention.

Referring to FIG. 5, a planar reflector 44 may include a plurality of loop electrical conductors 46 defining an array 45 of parasitically drivable antenna elements where each of the loop electrical conductors 46 comprises a solid conductive disc. Alternatively, as illustrated in FIG. 6, the planar reflector 54 may be an electrically conductive sheet including a plurality of circular holes 57 therein, and each of the loop electrical conductors 56 may then be defined by a periphery of one of the circular holes 57. In FIG. 6, the shaded areas are electrically conductive and the light areas are dielectric and insulative. The FIG. 5 embodiment corresponds to the panel form of a circular antenna element, the FIG. 6 embodiment corresponds to the slot form of a circular antenna element, and the FIG. 3 embodiment corresponds to the skeleton form of a circular antenna element. The panel, slot and skeleton antenna compliments may be familiar for dipoles (see for example "Antennas", John Kraus, $2^{nd}$ Edition, Chap. 13). RF currents tend to flow along the edges of large electrically solid structures according to diffraction.

Prior art perforated sheet metal reflectors generally use hole circumferences much smaller than wavelength to avoid resonance. The FIG. 6 embodiment may differ from prior art perforated sheet metal reflectors in that the present invention holes are resonant and much larger at the operating frequency. An advantage therefore of the FIG. 6 embodiment is that it makes perforated reflectors more worthwhile at higher frequencies; e.g. above 4 to 10 GHz, as the tiny nonresonant holes necessary in prior art reflectors at these frequencies may not provide an appreciable reduction in wind load.

Figure 7:
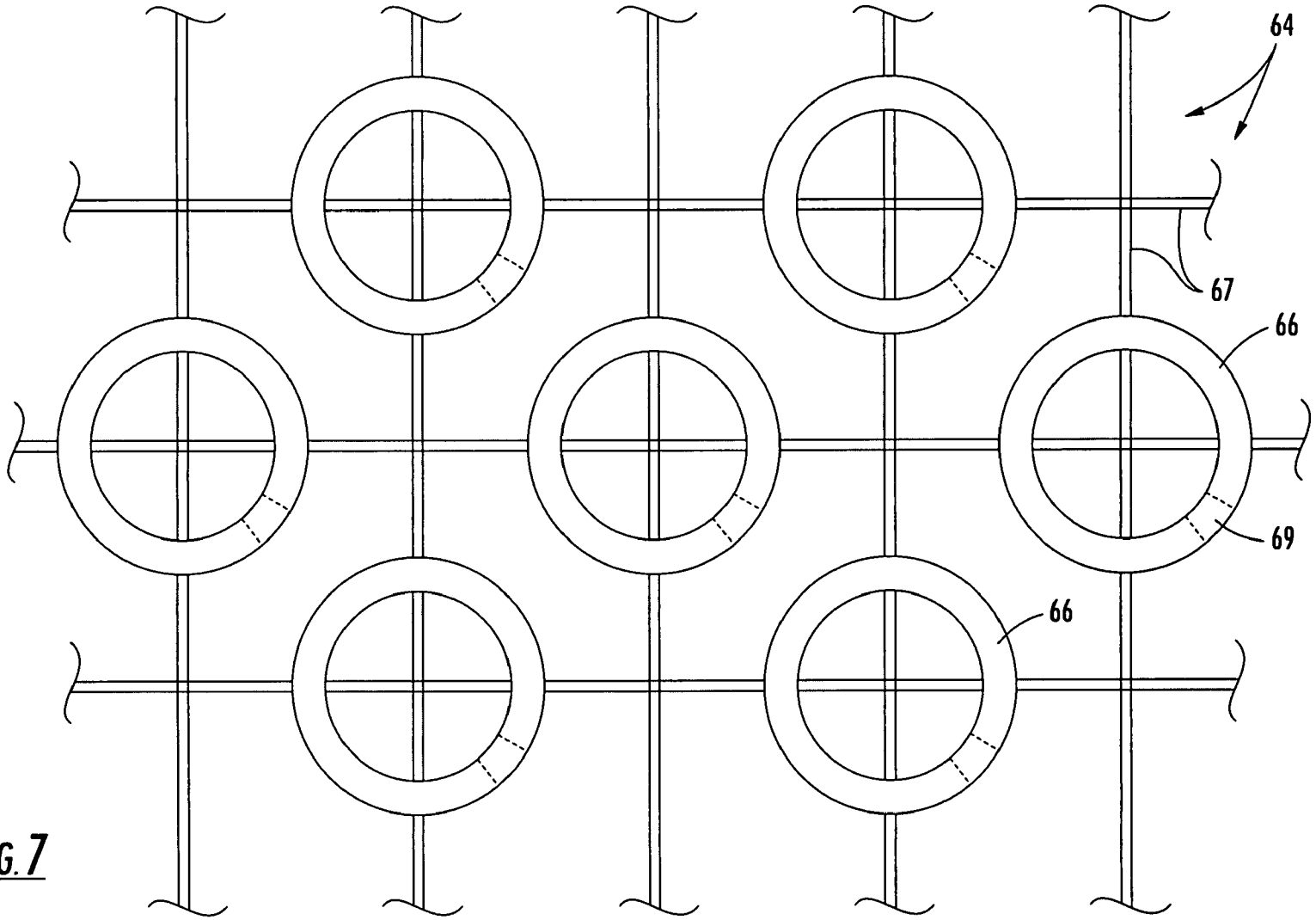
FIG. 7 is an enlarged schematic top plan view of a portion of the reflector and the array of loop electrical conductors of FIG. 3.

Referring now to the enlarged view of FIG. 7, the planar reflector 64 may include a dielectric mesh 67 suspending the plurality of loop electrical conductors 66 in the array. For example, the dielectric mesh 67 may be a grid of strings or rods. The dielectric mesh 67 may define a dielectric substrate having a plurality of openings therein and supporting the plurality of loop electrical conductors 66 in the array. Also, each of the plurality of loop electrical conductors 66 may include at least one discontinuity 69 therein, e.g. for tuning and/or selection of polarization.

A method aspect is directed to making an antenna 30 including forming a planar reflector 34 with a plurality of loop electrical conductors 36 defining an array 35 of parasitically drivable antenna elements, and positioning a circularly polarized antenna feed 32 adjacent the planar reflector 34 to parasitically drive the array of parasitically drivable antenna elements and impart a traveling wave current distribution therein.

The loop elements may be ellipses and of various sizes for the control of phase or polarization, especially at the periphery of the array. Array 35 may include two or more successive planes of loop electrical conductors 36 to obtain unidirectional radiation from antenna 30. Two axially spaced loops can provide about 6.2 dBic gain at 0.2λ spacing, which may be 1.5 dB more than the unidirectional directive effects of a crossed yagi-uda array. As is common for the yagi-uda, the frontward loop element may be smaller then the rearward element. For operation over bandwidth, it is preferential that feed 36 have a stable phase center over frequency, so that the radiation there-from does not wander from the "focal point" of array 35. Resonance in the full wave loop antenna elements occurs at slightly more than 1.0λ circumference. Thin wire embodiments may resonate at 1.04λ.

With reference to FIG. 6, forming the planar reflector 54 may include forming a plurality of circular holes 57 in an electrically conductive sheet, and each of the loop electrical conductors 56 may be defined by a periphery of one of the circular holes 57. With reference to FIG. 7, forming the planar reflector 64 may include forming a dielectric mesh 67 suspending the plurality of loop electrical conductors 66 in the array, including, for example, forming the dielectric mesh as a grid of strings or rods.

In accordance with features of the present invention as described above, a relatively compact circularly polarized reflector antenna with sufficient gain may be achieved, using loop or closed circuit elements. The antenna may have properties that are hybrid between those of parabolic reflectors and driven arrays, with the capability of having low wind load, and may be used in various fields, such as satellite communications and/or portable radio applications.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna comprising:

a planar reflector including a plurality of circular loop electrical conductors defining an array of parasitically drivable antenna elements; and a circularly polarized antenna feed spaced from the planar reflector to parasitically drive the array of parasitically drivable antenna elements and impart a traveling wave current distribution therein;

a circumference of the circular loop electrical conductors being near full wave resonance which is equal to about one wavelength (λ);

wherein each of the plurality of circular loop electrical conductors includes at least one discontinuity therein configured for antenna polarization selection.

2. The antenna according to claim 1, wherein each of the loop electrical conductors comprises a wire.

3. The antenna according to claim 1, wherein each of the loop electrical conductors comprises at least one of a printed conductive trace and a metal ring.

4. The antenna according to claim 1, wherein each of the loop electrical conductors comprises a solid conductive disc.

5. The antenna according to claim 1, wherein the planar reflector comprises an electrically conductive sheet including a plurality of circular holes therein, and each of the loop electrical conductors is defined by a periphery of one of the circular holes.

6. The antenna according to claim 1, wherein the planar reflector comprises a dielectric mesh suspending the plurality of loop electrical conductors in the array.

7. The antenna according to claim 6, wherein the dielectric mesh comprises a grid of strings or rods.

8. The antenna according to claim 1, wherein the planar reflector comprises a dielectric substrate having a plurality of openings therein and supporting the plurality of loop electrical conductors in the array.

9. An antenna comprising:

a planar reflector including a dielectric mesh and an array of circular electrical conductors suspended thereby; and a circularly polarized antenna feed adjacent the planar reflector to parasitically drive the array of circular electrical conductors and impart a traveling wave current distribution therein;

a circumference of the circular electrical conductors being near full wave resonance which is equal to about one wavelength (λ);

wherein each of the plurality of circular electrical conductors includes at least one discontinuity therein configured for antenna polarization selection.

10. The antenna according to claim 9, wherein each of the circular electrical conductors comprises at least one of a wire, a printed conductive trace, a metal ring and a solid conductive disc.

11. The antenna according to claim 9, wherein the planar reflector comprises an electrically conductive disc including a plurality of circular holes therein, and each of the circular electrical conductors is defined by a periphery of one of the circular holes.

12. The antenna according to claim 9, wherein the dielectric mesh comprises a grid of strings or rods.

13. The antenna according to claim 9, wherein the dielectric mesh comprises a dielectric substrate having a plurality of openings therein and supporting the plurality of circular electrical conductors in the array.

14. A method of making an antenna comprising:

forming a planar reflector including a plurality of circular loop electrical conductors defining an array of parasitically drivable antenna elements; and positioning a circularly polarized antenna feed adjacent the planar reflector to parasitically drive the array of parasitically drivable antenna elements and impart a traveling wave current distribution therein;

a circumference of the circular loop electrical conductors being near full wave resonance which is equal to about one wavelength (λ);

wherein each of the plurality of circular loop electrical conductors includes at least one discontinuity therein configured for antenna polarization selection.

15. The method according to claim 14, wherein forming the planar reflector includes forming each of the circular loop electrical conductors as at least one of a wire, a printed conductive trace, a metal ring and a solid conductive disc.

16. The method according to claim 14, wherein forming the planar reflector comprises forming a plurality of circular holes in an electrically conductive sheet; and wherein each of the circular loop electrical conductors is defined by a periphery of one of the circular holes.

17. The method according to claim 14, wherein forming the planar reflector comprises forming a dielectric mesh suspending the plurality of circular loop electrical conductors in the array.

18. The method according to claim 17, wherein forming the dielectric mesh comprises forming a grid of strings or rods.

19. The method according to claim 14, wherein forming the planar reflector comprises forming a plurality of openings in a dielectric substrate, and supporting the plurality of circular loop electrical conductors on the substrate.

20. The method according to claim 14, wherein forming each of the plurality of circular loop electrical conductors includes forming at least one discontinuity therein.

* * * * *